US011452383B2

(12) United States Patent
Gladney et al.

(10) Patent No.: US 11,452,383 B2
(45) Date of Patent: Sep. 27, 2022

(54) MATTRESS WITH CROWNED PANEL

(71) Applicant: DREAMWELL, LTD., Doraville, GA (US)

(72) Inventors: Richard F. Gladney, Fairburn, GA (US); Corey Westerman, Newnan, GA (US)

(73) Assignee: DREAMWELL, LTD., Doraville, GA (US)

( * ) Notice: Subject to any disclaimer, the term of this patent is extended or adjusted under 35 U.S.C. 154(b) by 0 days.

(21) Appl. No.: 17/670,557

(22) Filed: Feb. 14, 2022

(65) Prior Publication Data

US 2022/0248868 A1 Aug. 11, 2022

Related U.S. Application Data

(63) Continuation of application No. 11/416,927, filed on May 2, 2006, now Pat. No. 11,259,647.

(51) Int. Cl.
*A47C 31/00* (2006.01)
*A47C 27/00* (2006.01)
(Continued)

(52) U.S. Cl.
CPC ..... *A47C 31/001* (2013.01); *A47C 27/002* (2013.01); *A47C 27/001* (2013.01); *A47C 27/04* (2013.01); *A47C 27/20* (2013.01)

(58) Field of Classification Search
CPC ..... A47C 27/15; A47C 27/148; A47C 27/144; A47C 27/14; A47C 27/085; A47C 27/146;
(Continued)

(56) References Cited

U.S. PATENT DOCUMENTS 848,437 A 3/1907 Brown
D43,449 S * 1/1913 Burton ..... D6/605
(Continued)

FOREIGN PATENT DOCUMENTS

EP 0096534 B1 12/1985
EP 2019610 B1 12/2018
GB 803408 10/1958

OTHER PUBLICATIONS

International Search Report for Application No. PCT/US2007/010626; dated Nov. 28, 2007; 3 pages.
(Continued)

*Primary Examiner* — Peter M. Cuomo
*Assistant Examiner* — Morgan J McClure
(74) *Attorney, Agent, or Firm* — Cantor Colburn LLP

(57) ABSTRACT

Mattresses and improved fabric covers for providing mattresses that have smooth surfaces. Additionally, methods for manufacturing non-quilted mattress covers and for manufacturing mattresses employing non-quilted mattress covers. The systems and methods described herein include mattress panels that can be manufactured separate from the inner core construction, and laid over the inner core to be fastened in place as a sleeping surface for the mattress. Optionally, these mattress panels can include a layer of fire retardant material, that may be added as a layer of material or that may be incorporated into one or more of the layers, such as a filler layer, in the mattress panel.

10 Claims, 5 Drawing Sheets

(51) Int. Cl.
*A47C 27/20* (2006.01)
*A47C 27/04* (2006.01)

(58) Field of Classification Search
CPC ..... A47C 27/002; A47C 27/05; A47C 27/001; A47C 27/04; A47C 27/045; A47C 27/088; A47C 27/12; A47C 27/121; A47C 27/122; A47C 27/124; A47C 27/125; A47C 27/127; A47C 27/16; A47C 27/20; A47C 27/22; A47C 31/001
See application file for complete search history.

(56) References Cited

U.S. PATENT DOCUMENTS 1,205,135 A * 11/1916 Farrow et al. ..... A47C 27/05 5/717
1,238,302 A * 8/1917 Kronlund ..... A47C 27/05 5/721
1,430,946 A * 10/1922 Clagett, Jr. ..... A47C 27/003 5/729
1,710,400 A * 4/1929 Bebout ..... A61G 13/009 5/632
1,925,766 A * 9/1933 Lofman ..... A47C 27/064 5/717
2,265,304 A * 12/1941 Nachman, Jr. ..... A47C 27/04 5/655.7
2,316,687 A * 4/1943 Hammond ..... A47C 27/127 267/145
D139,146 S * 10/1944 Martin ..... D6/605
2,403,043 A * 7/1946 Bowersox ..... A47C 27/12 5/696
2,528,313 A * 10/1950 Kessler ..... A47G 9/0246 5/497
2,619,659 A * 12/1952 Futterknecht ..... A47C 27/15 428/102
2,621,341 A * 12/1952 Woods ..... A47C 27/001 5/722
2,675,566 A * 4/1954 Lieberman ..... A47C 23/0435 5/721
2,856,615 A * 10/1958 Cirocco ..... A47C 31/105 5/500
2,858,881 A * 11/1958 Newall ..... A47C 27/146 428/117
2,926,660 A * 3/1960 Thompson ..... A61G 13/009 5/613
2,987,735 A * 6/1961 Nail ..... A47C 4/54 297/452.17
3,308,491 A 3/1967 Spence
3,370,306 A * 2/1968 Lovette ..... A47C 27/16 5/659
3,747,916 A * 7/1973 Benson ..... A47C 20/026 5/725
3,751,742 A 8/1973 Worley
3,857,126 A 12/1974 Woodruff
4,187,567 A * 2/1980 Crowther ..... A47C 27/085 5/915
4,207,635 A * 6/1980 Leroy ..... A47C 21/00 5/430
4,244,065 A * 1/1981 Hartwell ..... A47C 27/085 5/679
4,281,425 A * 8/1981 Jacobs ..... A47C 27/085 5/678
4,330,893 A * 5/1982 Matsui ..... A47C 27/085 5/665
4,388,738 A * 6/1983 Wagner ..... A47C 21/048 5/738
4,504,991 A * 3/1985 Klancnik ..... B32B 5/028 297/DIG. 5
4,580,301 A * 4/1986 Ludman ..... A61G 7/05715 5/724
4,686,721 A * 8/1987 Hubert ..... A47C 27/085 5/678
4,720,415 A * 1/1988 Vander Wielen ..... A61F 13/15593 428/152
4,777,681 A 10/1988 Luck et al.
4,829,615 A * 5/1989 Raymond ..... A47C 21/022 D6/605
4,858,258 A * 8/1989 Mizelle ..... A47C 27/146 5/174
4,947,500 A * 8/1990 Seiler ..... A47C 27/081 5/713
4,962,546 A * 10/1990 Vitale ..... A47C 31/105 5/500
D313,722 S * 1/1991 Axelson ..... D6/605
5,003,655 A * 4/1991 Kafai ..... A47G 9/0238 5/497
5,144,705 A * 9/1992 Rogers ..... A61B 5/6892 5/654
5,201,780 A * 4/1993 Dinsmoor, III .... A61G 7/05715 5/679
5,285,541 A * 2/1994 Steed ..... A47C 27/085 5/678
D347,541 S * 6/1994 Cook ..... D6/601
5,327,597 A * 7/1994 Rothbard ..... A47C 27/146 5/736
5,353,455 A * 10/1994 Loving ..... A47C 23/002 29/451
5,406,660 A * 4/1995 Johenning ..... A47C 27/085 5/684
5,475,881 A * 12/1995 Higgins ..... A47C 31/105 5/737
5,523,144 A 6/1996 Dyer, Jr.
5,809,593 A * 9/1998 Edwards ..... A47G 9/0246 5/482
5,845,350 A * 12/1998 Beemiller ..... A47D 9/02 5/915
6,098,224 A * 8/2000 Gladney ..... A47C 27/064 5/643
6,163,907 A * 12/2000 Larson ..... A47C 21/048 5/691
6,351,864 B1 * 3/2002 Karafa ..... A47C 27/146 5/724
6,491,717 B1 * 12/2002 Stanley ..... A61H 23/04 607/104
D479,082 S * 9/2003 Daughtery ..... D6/596
6,611,979 B2 * 9/2003 Welling ..... A61G 7/002 5/624
6,721,982 B2 4/2004 Freeman
6,772,825 B2 * 8/2004 Lachenbruch ..... A61F 7/0053 5/655.5
6,823,548 B2 * 11/2004 Murphy ..... B32B 27/42 5/690
6,968,585 B2 * 11/2005 Shaw ..... A61G 7/057 5/655.9
6,994,043 B1 2/2006 Price
7,047,580 B2 * 5/2006 Finn ..... A47C 27/005 5/486
7,240,386 B1 * 7/2007 McKay ..... A47C 21/044 5/724
7,254,852 B2 * 8/2007 Martin ..... A47G 9/10 5/636
D554,208 S * 10/2007 Palaszek ..... D21/662
7,296,314 B2 * 11/2007 Wyatt ..... A61G 7/05715 5/713
7,467,432 B2 * 12/2008 Brogan ..... A47G 9/10 5/636
7,685,664 B2 * 3/2010 Stolpmann ..... A61G 7/05715 5/710
7,996,937 B2 * 8/2011 Walter ..... A47G 9/0246 5/497
8,607,387 B2 * 12/2013 Flick ..... A47C 7/0213 5/655.5
8,832,888 B2 * 9/2014 Chunglo ..... A47C 27/146 5/724
8,997,279 B1 * 4/2015 McKay ..... A47C 23/002 5/652.2
9,167,919 B2 * 10/2015 Walker ..... A47G 9/0246

(56) References Cited

U.S. PATENT DOCUMENTS

| | | | | |
|---|---|---|---|---|
| 9,854,922 | B1 * | 1/2018 | Schiller | A47C 27/15 |
| 9,962,902 | B2 * | 5/2018 | Losio | B32B 3/02 |
| 2003/0177583 | A1 | 9/2003 | Freeman | |
| 2004/0172765 | A1 * | 9/2004 | England | A47C 27/05 5/717 |
| 2005/0278852 | A1 * | 12/2005 | Wahrmund | A47G 9/1081 5/636 |
| 2007/0079438 | A1 * | 4/2007 | Patterson | A61G 7/1032 5/81.1 C |
| 2008/0028528 | A1 * | 2/2008 | Wilson | A61F 5/01 5/636 |
| 2011/0252568 | A1 * | 10/2011 | Ramp | A47C 20/027 5/655.5 |
| 2014/0182061 | A1 * | 7/2014 | Zaiss | A61G 7/05792 5/423 |
| 2014/0359939 | A1 * | 12/2014 | Carlitz | A47C 27/15 156/254 |
| 2015/0328070 | A1 * | 11/2015 | Tarplee | A47C 21/006 5/616 |
| 2016/0198862 | A1 * | 7/2016 | Farley | A47C 27/148 5/727 |

OTHER PUBLICATIONS

Office Action issued in European Patent Application No. 07 794 490.8-1653, dated Nov. 9, 2015; 5 pages.

* cited by examiner

MATTRESS WITH CROWNED PANEL

CROSS REFERENCE TO RELATED APPLICATIONS

The present application is a continuation application of and claims priority to U.S. patent application Ser. No. 11/416,927 to Gladney et al, incorporated herein by reference in its entirety.

BACKGROUND

Mattress manufacture typically employs the covering of a resilient spring interior with a fabric cover that provides much of the comfort and the appearance of the mattress product. Such fabric covers are commonly made of quilted material formed by stitching patterns on multiple layered fabrics formed of a layer of backing material, one or more layers of thick filler material and an outer layer of facing material or ticking. The quilted fabric covers are most often formed on needle sewing machines that stitch the layers of material together with stitched patterns that contribute to the ornamental features of the mattress product. The layers of material become compressed along the lines of thread stitched into the layers. The contrast between the uncompressed layers of material and the indented stitch lines form an uneven surface on the mattress fabric cover.

The quilting operation by the sewing machines also provides the functional joining of the material that forms the quilted mattress cover. Although the sewing machines are generally reliable, the needles of the sewing machines repeated travel through several layers of material to sew the layers together and may break with use. This may damage, not only the sewing machine, but also the materials being quilted together. Moreover, a sewing machine may malfunction while stitching in various ways, such as mechanically jamming due to fabric or thread accidentally catching a moving part.

Accordingly, there is a need in the art for smooth mattress panels and mattress covers formed without being quilted.

BRIEF SUMMARY

The systems and methods described herein include improved mattresses and improved fabric covers for providing mattresses that have smooth surfaces. Additionally, the invention encompasses methods for manufacturing non-quilted mattress covers and for manufacturing mattresses employing non-quilted mattress covers. The systems and methods described herein include mattress panels that can be manufactured separate from the inner core construction, and laid over the inner core to be fastened in place as a sleeping surface for the mattress. Optionally, these mattress panels can include a layer of fire retardant material, that may be added as a layer of material or that may be incorporated into one or more of the layers, such as a filler layer, in the mattress panel.

According to one embodiment of the invention, a mattress comprises a core of inner springs and a mattress panel having a substantially smooth or even top surface. In certain embodiments, the mattress panel increases in thickness from the edge to a center portion, optionally at a substantially uniform angle. The panel may be composed of a fabric layer, a filler layer, and a backing layer. The panel may include an additional layer, such as a padding layer, a foam layer, or a water-resistant layer. The layers of material may be joined together at one or more edges of the panel. The layers of material may be joined at an edge by stitching, for example, overcast stitching and/or serging. The layers of material may also be joined at an edge by gluing, stapling, tying, melting or through any other mechanical or chemical joining technique, such as by rings, snaps, or grommets, or adhesive. The edges of the panel may be covered by a strip of fabric. The layers of material also may be bonded into one sheet by gluing, melting, or by using loop and hook fasteners.

According to a further embodiment of the invention, a mattress panel may be manufactured by providing a fabric layer, a filler layer, and a backing layer, overlaying or overlapping the fabric, filler and backing layers to form a common perimeter, and joining the perimeter of the fabric, filler and backing layers. In one embodiment, the fabric layer may have an angled lip section. In another embodiment, the filler layer may be a foam pad increasing in thickness from an edge to a center portion at a substantially uniform angle.

According to yet another embodiment, a mattress panel may be manufactured by providing a fabric layer, a filler layer, and a backing layer, cutting the fabric, filler and backing layers to form a perimeter, and joining the perimeter of the fabric, filler and backing layers.

According to a further embodiment of the invention, a flange is attached to the panel.

BRIEF DESCRIPTION OF THE DRAWINGS

Various illustrative systems, methods, devices, features and advantages of the invention are described below with reference to the appended drawings, which may not be drawn to scale and in which like parts are designated by like reference designations.

DETAILED DESCRIPTION

To provide an overall understanding of the invention, certain illustrative practices and embodiments will now be described, including a mattress having an improved fabric cover with an optional smooth sleeping surface, and methods for manufacturing non-quilted mattress covers and for manufacturing mattresses employing non-quilted mattress covers. However, it will be understood by one of ordinary skill in the art that the systems and methods described herein can be adapted and modified and applied in other applications and that such other additions, modifications and uses will not depart from the scope hereof. Referring now to the figures, in which like numerals designate like elements throughout the several views. FIGS. 1-5 illustrate various embodiments of the invention.

Figure 1A:
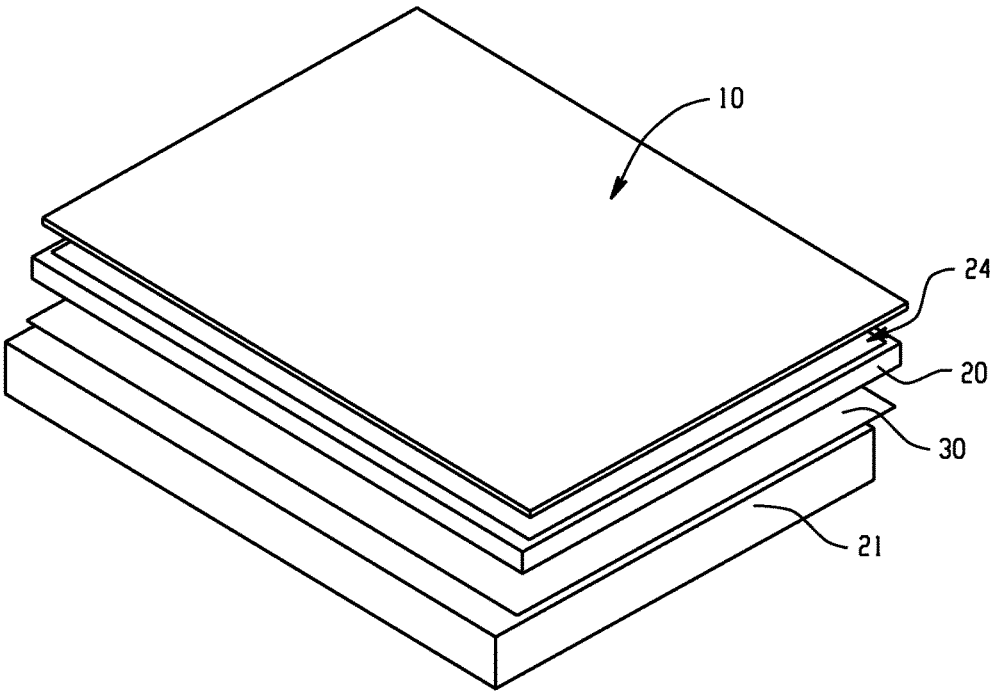
FIG. 1A depicts the layers of a mattress panel embodiment of a mattress according to the invention.

FIG. 1A shows several layers of material prior to assembly into a mattress panel. The fabric layer 10 is the top layer and may be any desired sheet of material, such as cotton, linen, synthetic fibers or a mixture thereof. The top layer 10 may be a flat sheet of fabric or may be a substantially flat sheet with an angled lip of fabric (not shown) formed at each edge of the top layer 10. A lip may be formed by cutting out a wedge of fabric from each corner of the top layer 10 which border the edge and joining the cut sections of the top layer 10 together. The lip may be from about 0.5 inches to about 7 inches in length. When a mattress is assembled, the top layer 10 is an outer surface of the mattress.

The filler layer 20 is the cushioning layer and may be formed from any padding material, such as foam, cotton batting, gel, latex, visco elastic foam or other known padding materials and or combination of padding materials. The filler layer 20 may be from about 0.25 inches to about 5 inches in height, preferably from about 1 inch to about 4 inches. In one preferred embodiment, the filler layer may be a foam substantially 3 inches in height with an ILD of 12 and a density of 1.2. However, in other embodiments, the ILD may be different from this preferred embodiment and the density and ILD can vary according to the application. In certain embodiments the density can range from about 1.0 to about 5.0 and the ILD can vary from, for example, about 10 to about 40 ILD. Other values may also be used without departing from the scope of the invention. The filler layer 20 may have a substantially flat, smooth upper surface or may have a textured or patterned upper surface. In some embodiments, the center section of the filler laver may have a uniform height and decrease at a uniform angle toward its edges. The filler layer 20 may have multiple zones, including a lumbar zone and a shoulder zone. For example, in one embodiment, the panel has a foam filler layer 20 that includes a layer of gel material that is formed within the foam layer and that extends from one side of the mattress to the other side, providing a zone of gel material at an area where the lumbar of a sleeping user would be positioned. The number of zones and the location of the zones may vary according to the application.

A fire resistant layer 24 may be placed between the tiller layer 20 and the fabric layer 10. In the depicted embodiment, the fire resistant layer 24 includes a barrier fabric 24 which can be incorporated in the panel structure between the fabric layer 10 and the filler layer 20, as shown. However, in the other embodiments, the fire resistant layer may be a sock-like enclosure that fits over and around the filler layer to protect all sides of the filler layer 20 from heat, fire and flame.

Optionally, the fire barrier fabric 24 can also be attached to one of the layers, for example, the top layer 10, with an adhesive. The fire barrier fabric 24, when used as the backing material, can significantly reduce the fire hazard due to the material properties of the fire barrier fabric 24 that will hinder the propagation of a fire to the mattress body. For added fire protection, the fire barrier fabric 24 can also be placed directly under a border ticking.

The exemplary mattress panel depicted in FIG. 1 includes a fire blocking layer of for example, Fireguard® LWB, sold by Chiquola Industrial Products, LLC, Honea Path, S.C., USA, which may optionally be included in both the mattress panels and the borders. The flame resistant material in another embodiment may be KEVLAR™ and PET (polyester) binder fiber, although other suitable materials may be employed and the actual material employed will depend upon the particulars of the application, including mattress type (e.g. open coil, pocketed coil, foam, water, and/or air), mattress size, material costs and other such factors.

In one exemplary optional embodiment, the depicted fire resistant layer 24 is formed of KEVLAR™ fibers and PET fibers that are formed into a layer of fabric. In one practice the layer of fabric is formed by blending and joining the fibers by use of an adhesive or binder. In other embodiments, the layer 24 may be a layer of fabric formed by a weave of KEVLAR™ and PET fibers. Still other techniques may be used to form the layer 24 and any suitable technique for forming the layer 24 may be employed.

The layer 24 shown in FIG. 1A may comprise KEVLAR fibers, but in other embodiments other suitable materials may be employed. Such other materials may be other flame resistant, or sometimes referred to as flame or fire retardant materials, and may include any of the commercially available flame resistant materials. These materials may be categorized into four general groups including inorganic materials, organophosphorous materials, halogenated organic materials (typically halogenated with chlorine or more popularly bromine) and nitrogen based compounds. Commercially available materials are sold under the tradenames NOMEX, KEVLAR, INDURA and others. Other materials include fire resistant balanced corespun yarn such as described in U.S. Pat. No. 5,540,980. The materials may comprise layers, or fibers incorporated into a layer, with the fibers being chopped fiber, staple fiber, spun yarn, and/or continuous filament. The type of fiber or layer used will depend upon the application. In other embodiments, the flame resistant layer may be a layer of treated material, such as cotton or polyurethane, where the treatment provides a degree of flame resistance. Fire resistant or retardant papers may also be employed. Still other flame resistant materials may be employed without departing from the scope of the invention.

The backing layer 30 may be formed from any desired sheet of material, such as natural fibers such as cotton or linen, aluminum, fiberglass, synthetic fibers or a mixture thereof. In one preferred embodiment, the backing layer 30 may be a non-woven polypropylene material weighing from about 0.3 to about 3.0 oz per square yard. Resistance to tearing and flexibility are primary concerns for the backing layer 30. In another preferred embodiment, the backing layer is formed from a fire-retardant material.

Additional padding, insulating, water-resistant, or fire-resistant layers may be incorporated. The various layers may be may be laminated together, joined by adhesive or otherwise combined to form a single sheet of material. The size of the sheets formed may vary according to the application, but in certain embodiments, the sheets may be sized as is conventional for mattress manufacture, which typically is about 88 inches in width.

Figure 1B:
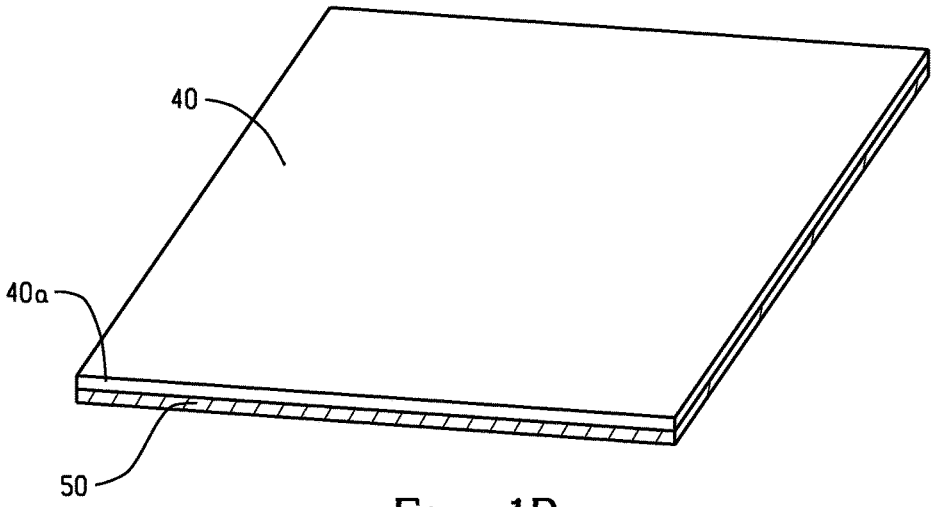
FIG. 1B is a perspective view of an assembled mattress panel embodiment according to the invention.

FIG. 1B depicts an assembled mattress panel 40 wherein the edges 40A of the mattress panel 40 are sewn with overcast stitches 50. The edges 40 *a* of the mattress panel 40 are compressed by the overcast stitches 50 and have height of about 0.25 inches to about 1.0 inches. The center 40 *b* of the mattress panel 40 is not compressed by any quilting or stitching and has a height of about 1.0 inches to about 4 inches, preferably about 3 inches.

Figure 1C:
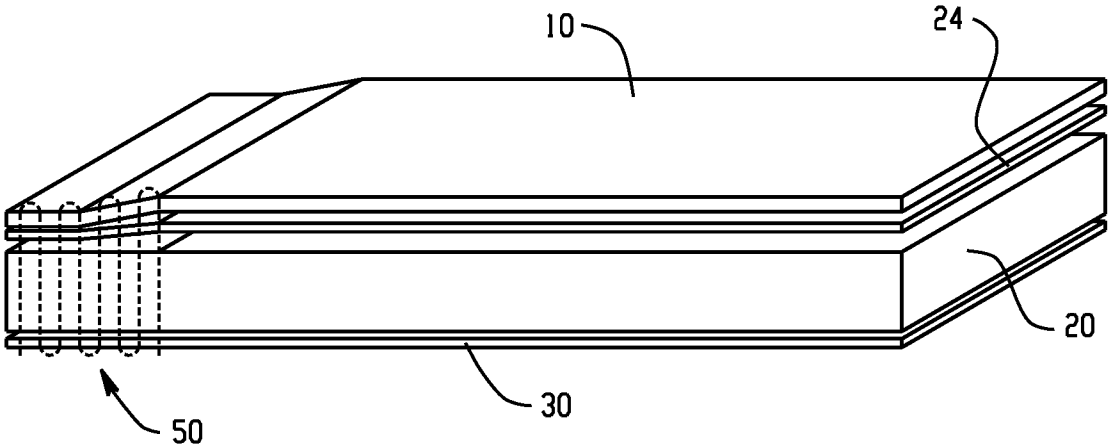
FIG. 1C is an exploded cross-sectional view of an edge of an assembled mattress panel embodiment according to the invention.

FIG. 1C depicts an exploded cross-sectional view of an edge of the assembled mattress panel 40 of FIG. 1B. Overcast stitches 50 join top layer 10, filler layer 20 and backing layer 30. Edge 40 *a* is compressed together by overcast stitches 50. Mattress panel 40 expands in height towards the center section of the mattress panel 40 as the center section of mattress panel 40 is not bound by any stitching.

It will be appreciated that FIGS. 1A, 1B and 1C depict together another aspect of the invention, which includes a method of manufacturing a mattress having a quiltless crown panel. As depicted above the panels may be formed as shown in FIG. 1A from a plurality of layers of materials that are disposed into a flange 7 and that are optionally overcast stitched to be joined together at the edge or edges. Overcast stitching is one preferred method of joining the layers, but in other embodiments and practices, the layers may be joined by other stitching processes, by application of adhesive, by clamping or by combinations thereof. Additionally, in other practices and embodiments the peripheral edges of the layers may be joined together and optionally other portions or sections of the layers may also be joined. This can include the center of the panel, or a border section of the panel, thereby forming a quilt-like appearance along the edge of the panel. Once the layers are joined, the flange 7 is typically secured to the innercore of the mattress to secure the panel in place. The flange 7 may be sized so that the fabric sidewall 21 extends above the interior layers when seated within the flange. In one embodiment for example, and only for example, the layers 10, 20, 24 and 30, when joined together are about one half to one inch in thickness. This thickness can vary as the materials used for the layers vary, the thickness of the different layers vary and as the number of layers may vary as well. The flange 7 may be stitched, glued or otherwise secured to the innercore. Further, in other optional embodiments, the flange may be absent from the panel and the joined layers may be directly secured to the innercore.

The panel thus formed may be disposed over a mattress core or body and secured thereto. Multiple panels may be applied to the mattress core, to cover the top surface, side surfaces and bottom. The number of sides covered can vary and those of skill in the art can choose which sides they wish to cover with the manufactured panels. The mattress panels may be attached to the mattress core by hog-rings, adhesive, plastic rings, stitching and combinations thereof. Other systems for attaching the panels to the mattress may be employed without departing from the scope of this application. It will be appreciated by those of skill in the art that the manufacturing techniques described herein produce less waste and material take up than current manufacturing quilting methods. Further, quiltless manufacturing may produce consistent panel sizing and higher quality panels, may be more manufacturing friendly and may requires less capital investments to manufacture.

Figure 2A:
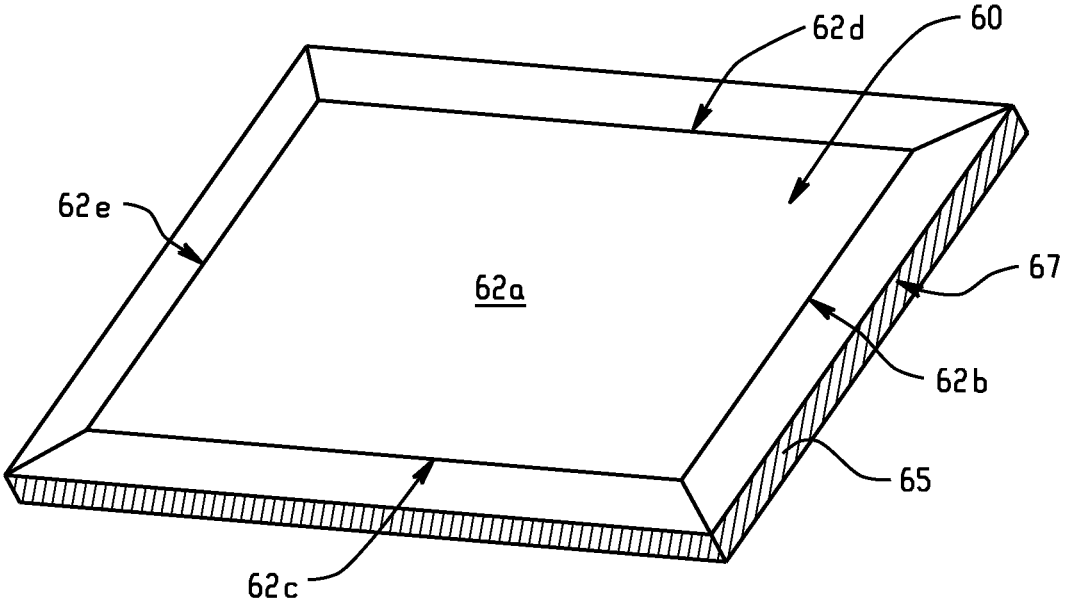
FIG. 2A depicts a perspective view of another assembled mattress panel embodiment according to the invention.

FIG. 2A depicts a second embodiment of a mattress panel according to the invention. The mattress panel 60 has a top layer 62, a filler layer (not shown), a backing layer (not shown), and a flange 67. The top layer 62, the tiller layer, backing layer and flange 67 are joined at an edge of the mattress panel 60 by overcast stitches 65. As more clearly depicted in FIG. 2B, mattress panel 60 is crowned, for example, center portion 62 *a* of the top layer 62 has a height greater than at the edge 63 and the height of the mattress panel 60 increases from the edge 63 to the center portion 62 *a* at a substantially uniform angle. The panel in this embodiment has a picture frame formed around the perimeter of the panel 60 and formed of a foam peripheral edge. The foam peripheral picture frame edge may be stitched to the other layers in the panel 6A) and optionally stitched to secure the panel 64) to the innercore of the mattress. In other embodiments, the picture frame peripheral edge may be absent from the panel and a layer of fabric or other material may be placed over the peripheral edge of the gel section and the stitching may pass directly through the gel to secure with the other layers and optionally with the innercore of the mattress.

In this alternative embodiment, a fire resistant layer may also be provided within the panel 60 by incorporating into one or more of the fabric layer, filler layer or backing layer, a fire resistant material, such as halogenated fire resistant fibers, or by forming one of these layers from a material that provides fire resistance or retards flames. Optionally, a separate fire resistant layer may be provided within the panel 60.

A flange, as the terms is used in the mattress construction industry, is a strip of material, generally non-woven, about 4 to 6 inches wide that is sewed to the underside of a mattress panel. Upon assembly of a mattress, the flange on the mattress panel is clipped or otherwise attached to the sides of the spring or foam mattress core to hold the mattress panel in place relative to the mattress core.

The top layer 62 is formed from five sections of fabric. The center section 62 *a* is attached at a first edge to lip section 62 *b*, a second edge to lip section 62 *c*, a third edge to lip section 62 *d*, and a fourth edge to lip section 62 *e*. A side of each lip section is joined to the bordering side of another lip section, for example, a side of lip section 62 *b* is joined to the bordering side of lip section 62 *c*, to form top layer 62 with lip sections 62 *b*, 62 *c*, 62 *d*, and 62 *e*.

In another embodiment, the top layer may be formed by cutting wedge shapes from each corner of a sheet of fabric and joining the bordering cut edges together.

The lip sections 62 *b*, 62 *c*, 62 *d*, and 62 *e* angle downward from center section 62 *a* toward the edges of the top layer 62. The lip sections 62 *b*, 62 *c*, 62 *d*, and 62 *e* may influence the expanded shape of the mattress panel 60. As described above with respect to FIG. 1C, the edges of mattress panel 60 are compressed together by overcast stitches 65 and expand in height toward the non-quilted center of the mattress panel 60. The lip sections 62 *b*, 62 *c*, 62 *d*, and 62 *e* may constrain the filler layer of the mattress panel 60 to expand at the angle of the lip sections 62 *b*, 62 *c*, 62 *d*, and 62 *e* rather than at the free rate of the tiller layer material.

The length of outer edges of sections 62 *b* and 62 *d* are substantially the same as are the length of outer edges of sections 62 *c* and 62 *e*. The widths of lip sections 62 *b*, 62 *c*, 62 *d*, and 62 *e* may have uniform widths or varying widths. For example, lip section 62 *b* may have a width of about 2 inches, lip sections 62 *c* and 62 *e* may have width of about 4 inches and lip section 62 *d* may have a width of about 5 inches.

Figure 2B:
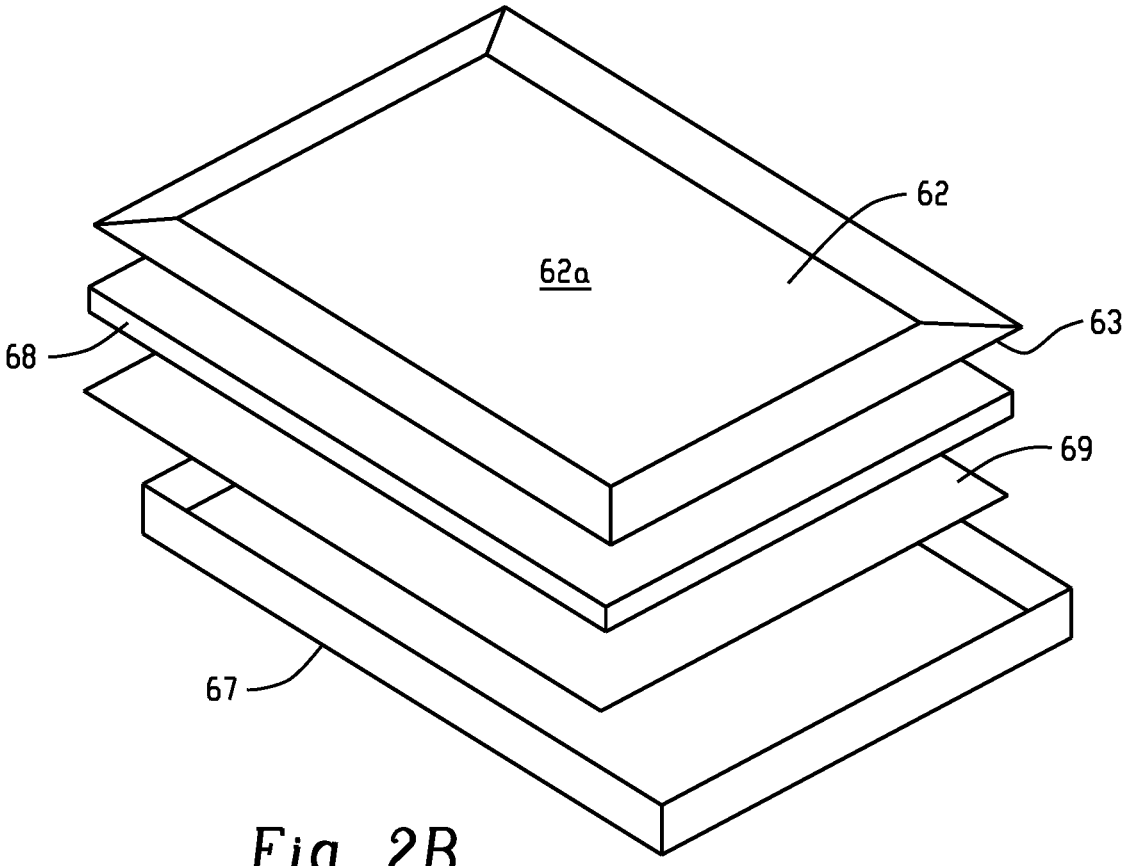
FIG. 2B is an exploded cross-sectional view of an edge of an assembled mattress panel of FIG. 2A.

FIG. 2B is an exploded cross-sectional view of an edge of an assembled mattress panel of FIG. 2A. Overcast stitches 65 join top layer 62, filler layer 68, backing layer 69, and flange 67. Edge 63 is compressed together by overcast stitches 65. Mattress panel 60 expands in height from edge 63 toward the center section 62 *a* of the mattress panel 60 at the angle of lip section 62 *d*. The lip section 62 *d* restrains the filler layer 68 from expanding in a curved fashion as depicted in FIG. 1C. The angle formed by the lip section 62 *d* and backing layer 69 may be from about 10 degrees to about 70 degrees, preferably from about 25 degrees to about 45 degrees.

In some embodiments, the filler layer may have a uniform height across its surface, thus when compressed by stitching, expands against and is restrained by a top laver. However, in other embodiments, the center section of the filler layer may have a uniform height and decrease toward its edges. In such embodiments, the top layer does not substantially restrain the filler layer from expanding.

Figure 3:
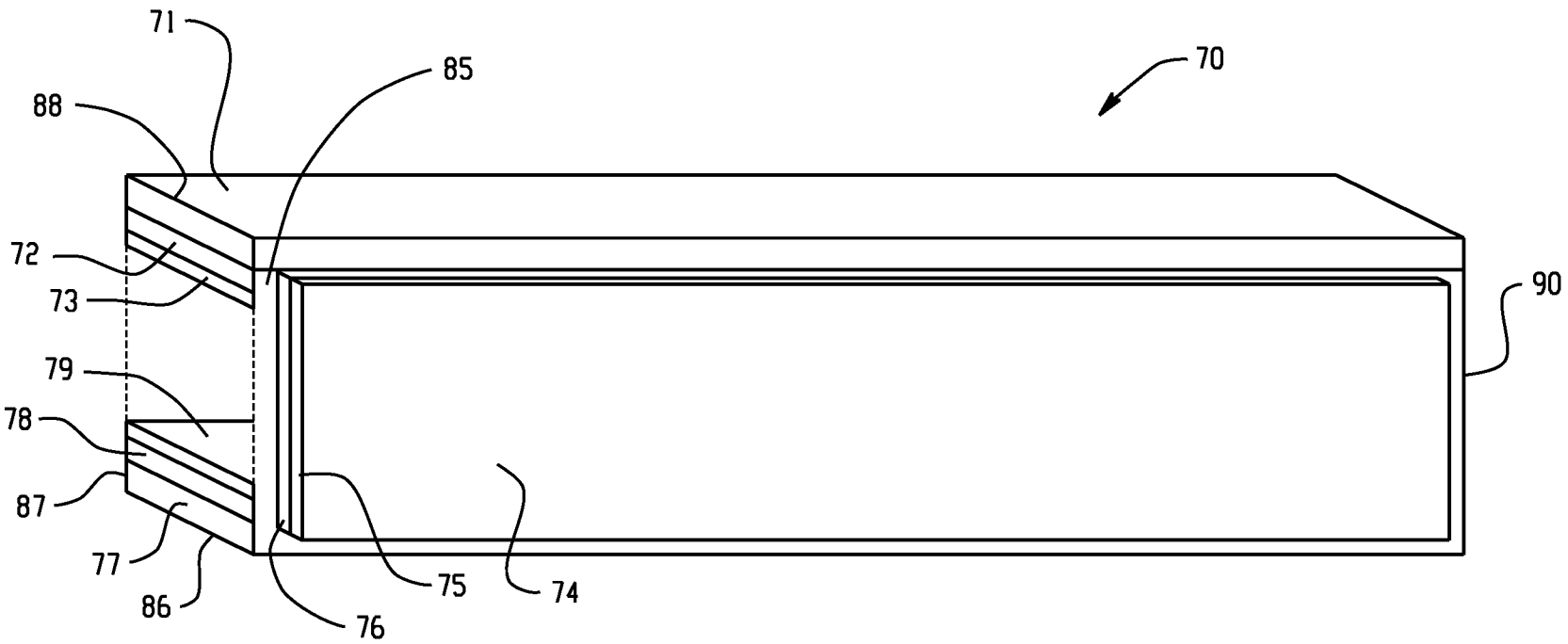
FIG. 3 depicts a cross-sectional view of an embodiment of an innerspring mattress according to the invention.

FIG. 3 depicts a cross-sectional view of an innerspring mattress embodiment according to one embodiment of the invention. The mattress 70 shows an innerspring mattress core 90 with crowned top, bottom and side mattress panels, however, a mattress may be formed with one or more conventional mattress panels. The top mattress panel is formed from top layer 71, filler layer 72, and backing layer 73. The bottom mattress panel is formed from top layer 77, tiller laver 78, and backing layer 79. Similarly, the right side mattress panel is formed from top layer 74, filler layer 75, and backing laver 76. The left side mattress panel is formed from top layer 80, filler layer 81, and backing layer 82. Either some or all of the panels may include an optional layer of fire resistant material. Alternatively, the mattress core 90 may be covered by a fire resistant enclosure, and the panels placed around the enclosed core.

The edge 85 joins the top mattress panel to the right side mattress panel. The edge 86 joins the right side mattress panel to the bottom mattress panel. The edge 87 joins the bottom mattress panel to the left side mattress panel. Joining of the top panel to the side border panel or panels may be accomplished by use of a tape edge machine or other suitable system or method. The edge 88 joins the top mattress panel to the left side mattress panel. Front and back side panels are not shown. Edges 85, 86, 87, and 88 may be covered with a strip of fabric for aesthetic effect. Typically, the mattress 70 will have a single side border panel that is sized to wrap around the full periphery of the mattress 70. However, multiple side border panels may also be used. It will be understood that during manufacture of the mattress 70, the top panel and side border panel may be selected from a number available panels, thereby providing for the panels used to the changed easily during manufacture. Thus, panels with fire resistant lay ers may be substituted for panels without such layers, and panels with zoned support, or gel material, may also be readily used or replaced during assembly. Further, the mattress 70 may use a side panel constructed according to the systems and methods described herein, with a side bore panel constructed using conventional techniques.

Figure 4:
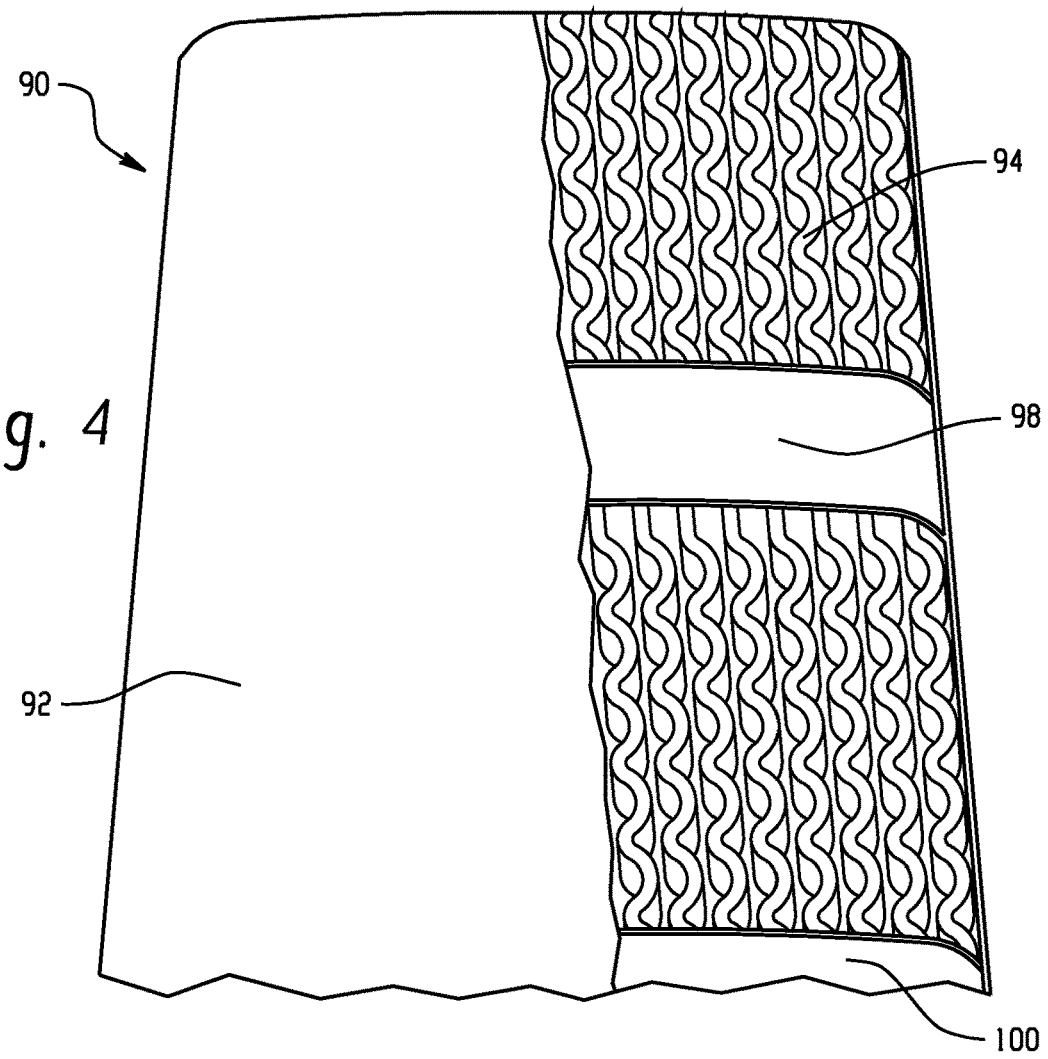
FIG. 4 presents a cut away view of one mattress according to the invention.
Figure 5:
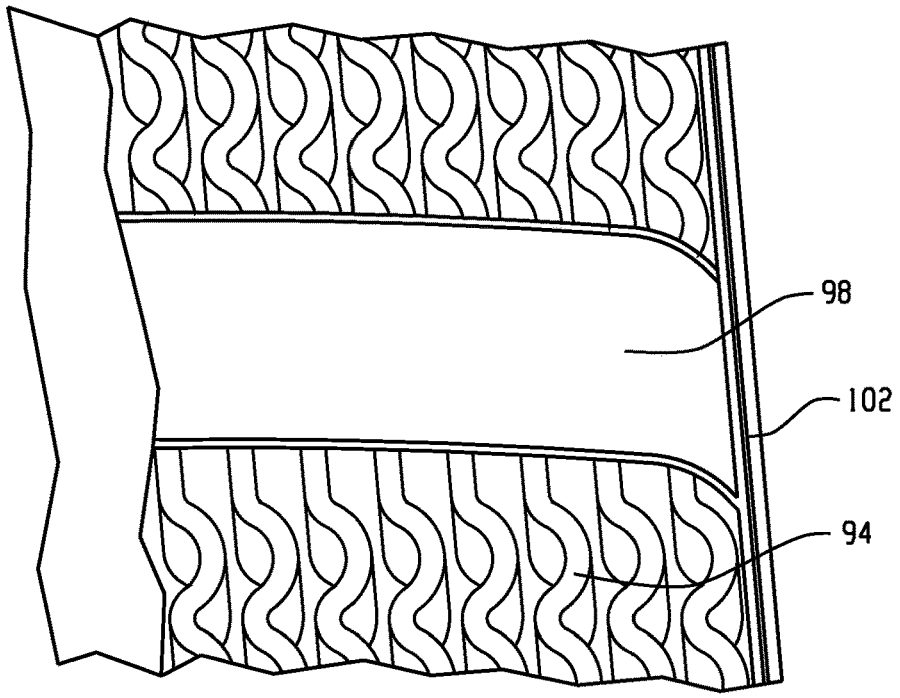
FIG. 5 shows in more detail one section of the panel, with a portion cutaway to show internal components.

FIGS. 4 and 5 depict a mattress according to the systems and methods described herein. In particular. FIG. 4 depicts a mattress 90 having a quiltless top panel 92, showing a cut away section that exposes the inner foam layer 94 and a gel section 98 that forms a support zone proximate to where the user's lumbar would be located, and a second zone 100 positioned below the lumbar zone. Specifically. FIG. 4 depicts the mattress 90 with a section of the upper fabric layer 92 cut away and replaced with a clear plastic film allowing the internal layers of the panel to be viewed. The foam layer 94 includes a zone of gel material 98 that extends from one side of the mattress to the other. FIG. 5 illustrates that the peripheral edge 102 of the panel was joined by action of a tape edge machine to the side border panel. FIG. 5 also shows the picture frame edge of the foam panel that is stitched to the other layers (not shown) of the panel 90. The panel 90 is then secured to the innercore of the mattress, also not shown.

The mattress panels may be attached to the mattress core by hog-rings. Hog-ringing is a conventional means of attaching fabric or padding to an innerspring construction, although other mechanical or adhesive means may be used.

It should also be understood that foam, plastic springs, or other resilient material, could also be used as a substitute for metal innerspring constructions.

Therefore, it may be seen that a mattress panel is provided which provides a substantially smooth exposed surface. Moreover, the mattress panel may have a crowned effect and is understood to provide longer life and be more durable than traditional panels.

While this invention has been described in specific detail with reference to the disclosed embodiments, it will be understood that many variations and modifications may be effected within the spirit and scope of the invention as described in the appended claims. For example, the mattress may include a foam core, or a combination of foam and springs. The mattress may be one-sided or two-sided. Consequently, those skilled in the art will know or be able to ascertain using no more than routine experimentation, many equivalents to the embodiments and practices described herein. Accordingly, it will be understood that the invention is not to be limited to the embodiments disclosed herein, but is to be understood from the following claims, which are to be interpreted as broadly as allowed under the law.

What is claimed is:

1. A mattress, comprising, a mattress core, a non-quilted crowned panel lying on the mattress core, wherein edges of the panel have a height of about 0.25 inches to about 1.0 inch and the center portion of the panel has a height of about 1 inch to about 4 inches, the non-quilted crowned panel consisting of, a fabric layer including a top surface and a bottom surface;

a fire-resistant layer provided on a bottom surface of the fabric layer;

a filler layer having a uniform thickness from 0.5 inches to 5 inches, wherein the filler layer comprises a viscoelastic foam having an indention load deflection of about 10 to 40 and a density of about 1.0 to 5.0 pounds per cubic foot, wherein the filler layer is disposed below the fire-resistant layer; and a backing layer underlying the filler layer;

wherein the fabric layer, fire-resistant layer, filler layer, and backing layer are compressively joined at respective edges such that the non-quilted crowned panel expands in height from the edge towards a center section of the panel, wherein the center section of the panel is free of stitching, wherein the filler layer in the center portion is not restrained by the fabric layer, and wherein the non-quilted mattress crown panel has a separate flange extending from the non-quilted crowned panel attached to side surfaces of the mattress core to secure the non-quilted mattress crown panel to the mattress core.

2. The mattress of claim 1, wherein the edges are covered with a strip of a fabric material.

3. The mattress of claim 1, wherein the filler layer includes a gel section to form a support zone.

4. The mattress of claim 3, wherein the support zone corresponds to a lumbar region.

5. The mattress of claim 1, wherein the fire-resistant layer includes a material selected from the group consisting of a halogenated material, Kevlar®, a thermoplastic material, inorganic fire-retardant materials, organophosphorous materials, fire resistant balanced corespun yarn, a layer of fire retardant treated cotton, a layer of fire retardant treated polyurethane, and fire retardant treated paper.

6. A mattress, comprising, a mattress core, a non-quilted crowned panel lying on the mattress core, wherein edges of the panel have a height of about 0.25 inches to about 1.0 inch and the center portion of the panel has a height of about 1 inch to about 4 inches, the non-quilted crowned panel consisting of, a fabric layer including a top surface and a bottom surface;

a filler layer having a uniform thickness from 0.5 inches to 5 inches, wherein the filler layer comprises a viscoelastic foam having an indention load deflection of about 10 to 40 and a density of about 1.0 to 5.0 pounds per cubic foot, wherein the filler layer is disposed below the fabric layer; and a backing layer underlying the filler layer;

wherein the fabric layer, filler layer, and backing layer are compressively joined at respective edges such that the non-quilted crowned panel expands in height from the edge towards a center section of the panel, wherein the center section of the panel is free of stitching, wherein the filler layer in the center portion is not restrained by the fabric layer, and wherein the non-quilted mattress crown panel has a separate flange extending from the non-quilted crowned panel attached to side surfaces of the mattress core to secure the non-quilted mattress crown panel to the mattress core.

7. The mattress of claim 6, wherein the edges are covered with a strip of a fabric material.

8. The mattress of claim 6, wherein the filler layer includes a gel section to form a support zone.

9. The mattress of claim 8, wherein the support zone corresponds to a lumbar region.

10. A mattress, comprising, a mattress core, a non-quilted crowned panel lying on the mattress core, wherein edges of the panel have a height of about 0.25 inches to about 1.0 inch and the center portion of the panel has a height of about 1 inch to about 4 inches, the non-quilted crowned panel consisting of, a fabric layer including a top surface and a bottom surface;

a filler layer having a uniform thickness from 0.5 inches to 4 inches, wherein the filler layer comprises a viscoelastic foam, wherein the filler layer is disposed below the fabric layer, and wherein the filler layer in the center portion is not restrained by the fabric layer; and a backing layer underlying the filler layer;

wherein the fabric layer, filler layer, and backing layer are compressively joined at respective edges such that the non-quilted crowned panel expands in height from the edge towards a center section of the panel, wherein the center section of the panel is free of stitching, and wherein the non-quilted mattress crown panel has a separate flange extending from the non-quilted crowned panel attached to side surfaces of the mattress core to secure the non-quilted mattress crown panel to the mattress core.

* * * * *